US011697059B2

(12) United States Patent
Poole

(10) Patent No.: US 11,697,059 B2
(45) Date of Patent: Jul. 11, 2023

(54) TOY

(71) Applicant: Christopher Poole, Birmingham (GB)

(72) Inventor: Christopher Poole, Birmingham (GB)

( * ) Notice: Subject to any disclaimer, the term of this patent is extended or adjusted under 35 U.S.C. 154(b) by 208 days.

(21) Appl. No.: 17/172,811

(22) Filed: Feb. 10, 2021

(65) Prior Publication Data

US 2022/0249943 A1 Aug. 11, 2022

(51) Int. Cl.
*A63F 9/14* (2006.01)

(52) U.S. Cl.
CPC ..... *A63F 9/14* (2013.01); *A63F 2250/024* (2013.01); *A63F 2250/0428* (2013.01)

(58) Field of Classification Search
CPC ..... A63F 9/14; A63F 2250/024; A63F 2250/0428; A63F 9/00; A63F 2009/2454; A63F 2009/247; A61H 19/44; A61H 19/50
See application file for complete search history.

(56) References Cited

U.S. PATENT DOCUMENTS 4,526,366 A * 7/1985 Kenoun ..... A63B 67/00 273/349
5,429,369 A * 7/1995 Hurst ..... A63F 7/045 273/287
8,794,486 B2 * 8/2014 Wolfinbarger ..... F41B 9/0071 446/153
2008/0277413 A1 * 11/2008 Jablonski ..... F41B 9/0012 222/401

OTHER PUBLICATIONS

EUIPO Publication and Register Extract, Design Registration No. 007448097-0001, dated Jan. 7, 2020.
Co-Pending Design U.S. Appl. No. 29/765,170, filed Jan. 6, 2021.

* cited by examiner

*Primary Examiner* — Michael D Dennis
(74) *Attorney, Agent, or Firm* — Caesar Rivise, PC

(57) ABSTRACT

A toy for use by at least two operators, the toy having an actuator for manipulation by each operator and a fluid reservoir, each actuator being operable to prime the fluid within the reservoir and to alter the direction of fluid flow so that actuation by a first operator may cause fluid to jet towards the second operator and vice versa.

13 Claims, 15 Drawing Sheets

TOY

BACKGROUND OF THE INVENTION

The apparatus and method described herein relate generally to a toy, and, in particular, to a toy for use by plural operators (e.g., simultaneously).

Use of toys which can be simultaneously operated by plural operators are known to foster cooperation and enhance teamwork. Further, such toys are typically found to be enjoyable for their operators to use. Further, such use may encourage a sense of competition, for example.

However, in recent years the rise of virtual games such as computer and video games has been believed to have led to a decline in the usage of simultaneously operable toys. Without wishing to be bound to any particular belief, this decline may in part have been due to the increasingly immersive nature of such virtual games.

Accordingly, described herein are apparatus and methods that enable a relatively more immersive experience than do prior art mechanical toys. The apparatus and methods provide for competition between users, for example with a penalty for the losing competitor.

BRIEF SUMMARY OF THE INVENTION

Accordingly, described herein are entertainment apparatus or toys for use (e.g., simultaneous use) by plural operators, the toys comprising: first and second user-operable actuators; a reservoir for retaining fluid; first and second outlets for emitting fluid from the reservoir to outside of the toy; and a direction determination mechanism; where the direction determination mechanism is configured or configurable, in use, to selectively allow or prevent fluid communication between the reservoir and the first and second outlets based on actuation of the first and/or second user-operable actuator.

Another aspect of the apparatus and methods described herein provides an entertainment apparatus or toy for use (e.g., simultaneous use) by plural operators, the toy comprising: at least one user-operable actuator; a reservoir for retaining fluid; at least one outlet for emitting fluid from the reservoir to outside of the toy; and a fluid release mechanism for selectively allowing or preventing fluid flow from the reservoir to the, one, some or each of the at least one outlet, where, in use, the fluid release mechanism is configured or configurable to allow or cause fluid flow from the reservoir to the, one, some or each of the at least one outlet when the, one, some or each of the at least one user-operable actuator has been actuated a predetermined number of times.

Another aspect of the apparatus and methods described herein provides an entertainment apparatus or toy for use (e.g. simultaneous use) by plural users, the toy comprising:

- a first user-operated actuator;
- a second user-operated actuator;
- a reservoir for holding fluid;
- a first fluid egress port;
- a second fluid egress port;
- the first fluid egress port and the second fluid egress port being selectively brought into fluid communication with the reservoir by actuation of the second user-operated actuator and the first user-operated actuator respectively.

The entertainment apparatus or toy may comprise a pressure generator to cause fluid within the reservoir to exit one or other of the first fluid egress port or the second fluid egress port. The toy may comprise a valve to provide selective fluid communication between the reservoir and one or other of the first fluid egress port and the second fluid egress port. The first user-operated actuator and the second user-operated actuator may each comprise a cam operable to cause the valve to move from a first position, where the reservoir is in fluid communication with first fluid egress port, to a second position, where the reservoir is in fluid communication with second fluid egress port, or from the second position to the first position respectively. The first user-operated actuator and the second user-operated actuator may be operable to prime the pressure generator.

It will be appreciated that the entertainment apparatus or toy provides or allows for competition between users with a penalty for the losing competitor. In this way the entertainment apparatus or toy fosters friendly competition with a degree of real-world jeopardy, thereby making use of the entertainment apparatus or toy more immersive.

For the avoidance of doubt, any of the features described herein apply equally to any aspect.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all examples and/or features of any example can be combined in any way and/or combination, unless such features are incompatible. For the avoidance of doubt, the terms "may", "and/or", "e.g.", "for example" and any similar term as used herein should be interpreted as non-limiting such that any feature so-described need not be present. Indeed, any combination of optional features is expressly envisaged without departing from the scope of the invention, whether or not these are expressly claimed. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1A:
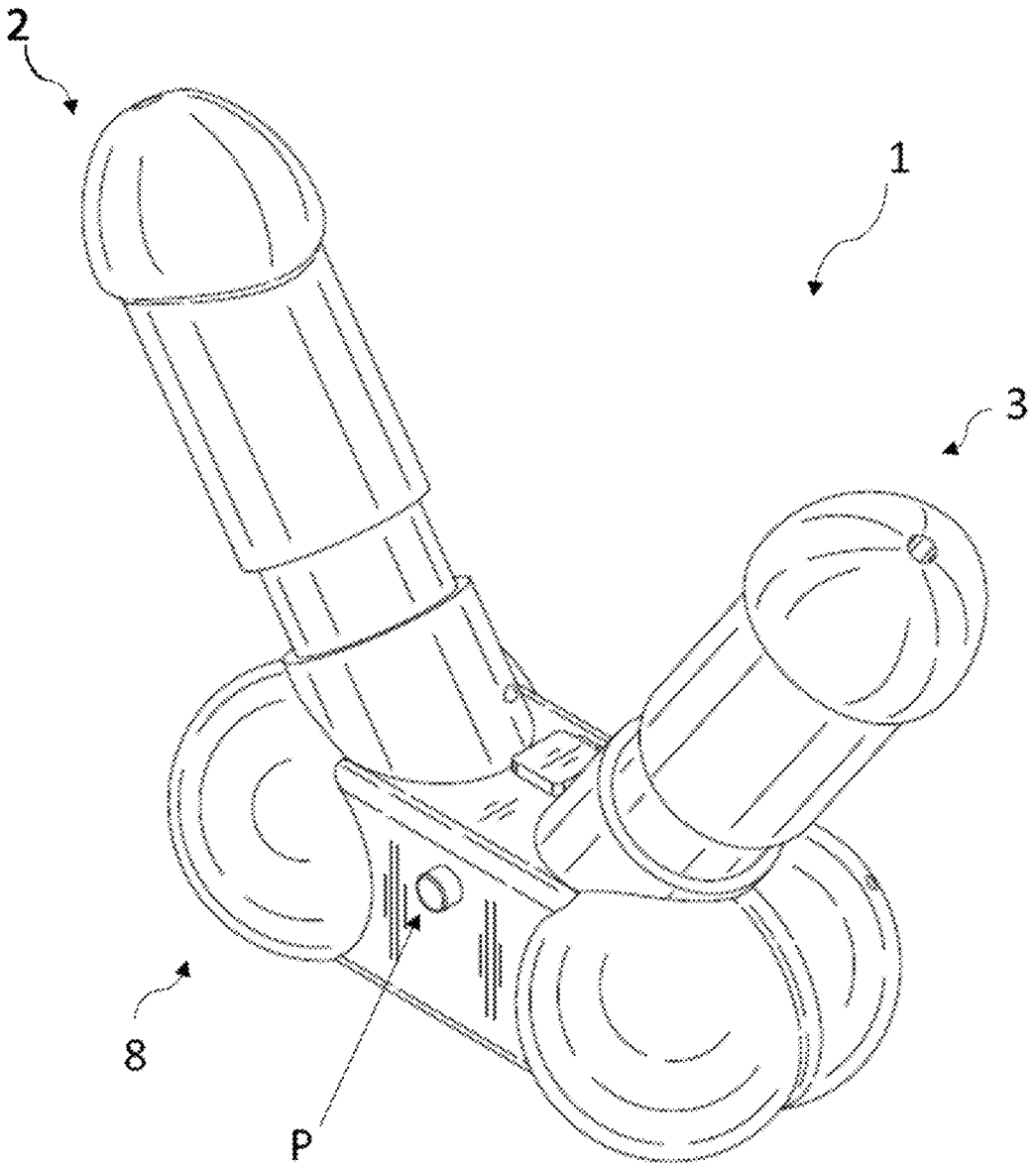
FIG. 1*a* is a schematic perspective view of an interactive toy according to an example of the methods and apparatus described herein.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Referring now to FIGS. 1*a* to 9, there is a shown an interactive toy 1 (e.g., toy) for use in competition between plural operators, according to an example of the methods and apparatus described herein. In use, the toy is simultaneously operated by two operators.

The interactive toy 1 comprises first and second actuators 2, 3, a reservoir 4 for retaining fluid, a determination mechanism 5, a pressurization mechanism 6, plural conduits 7 (for transfer of fluid) and a housing 8.

Actuators 2, 3

Figure 4:
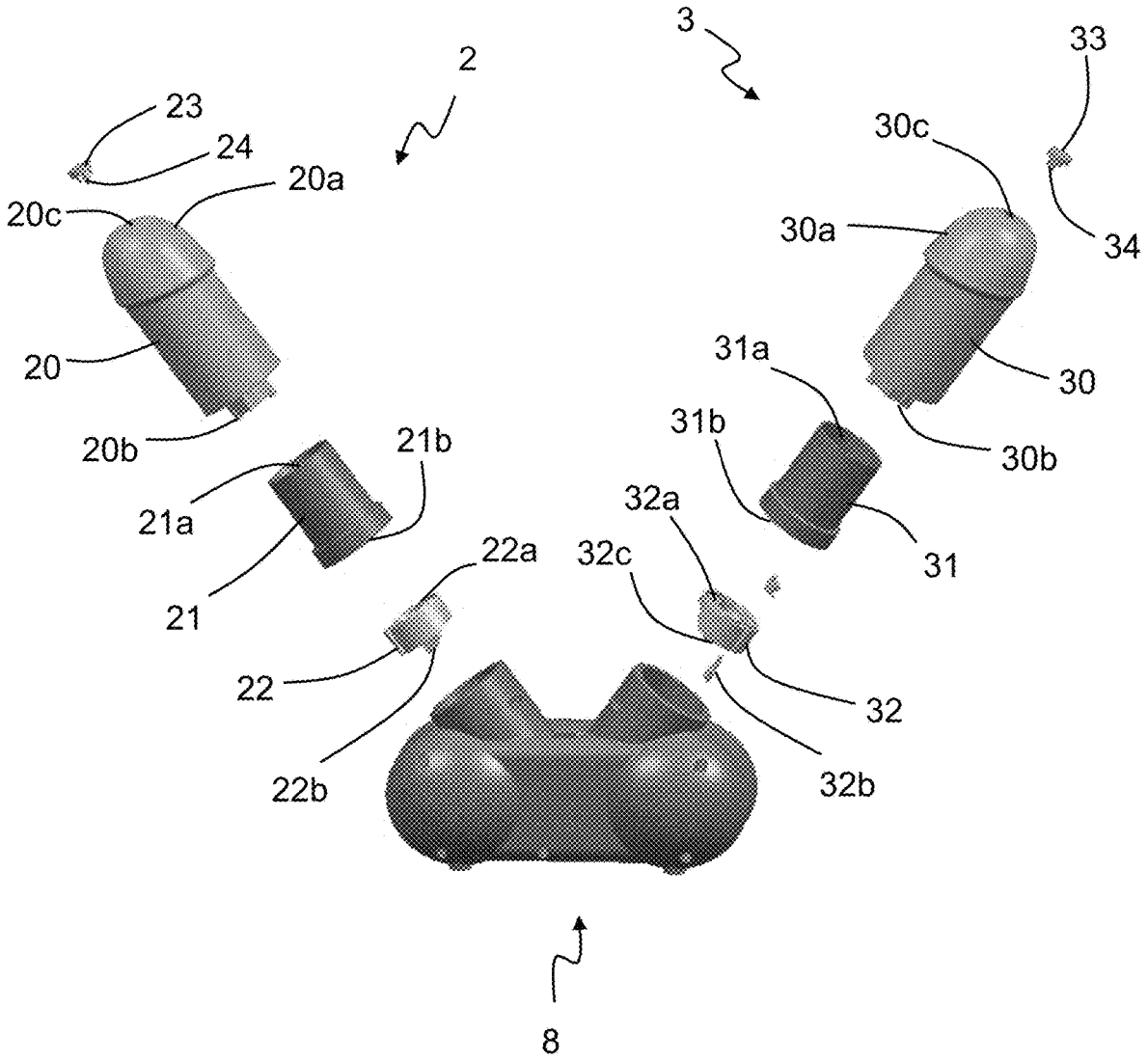
FIG. 4 is an exploded schematic view of the actuators and housing shown in FIG. 1*b;*

Referring now to FIG. 4, the first actuator 2 comprises an elongate member in this example. The first actuator 2 comprises a first handheld member 20, a first mounting member 21 and a first driven member 22.

Figure 1B:
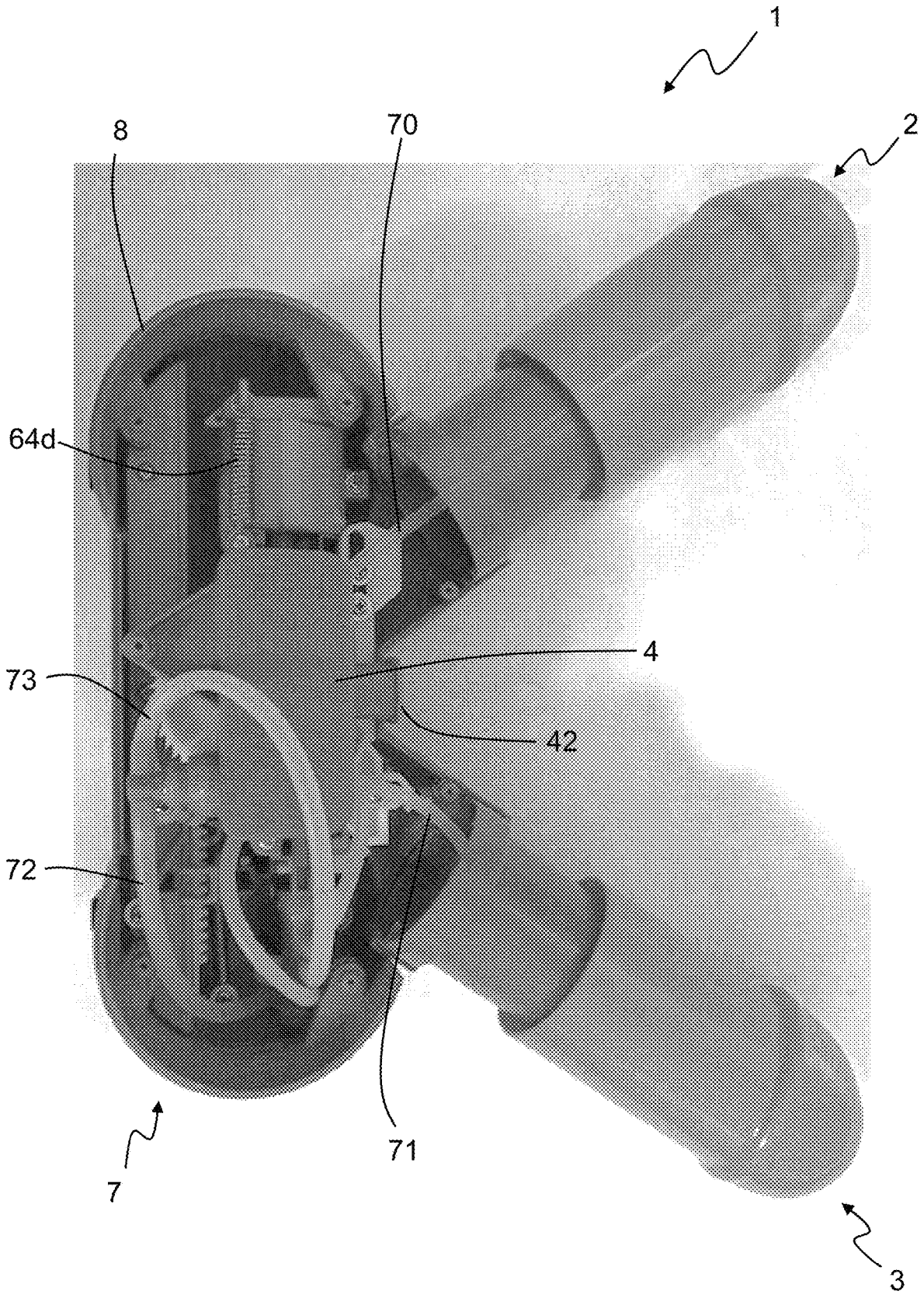
FIG. 1*b* is a side view of the interactive toy shown in FIG. 1*a*, in which the cover has been removed.

The first handheld member 20 is substantially cylindrical. The first handheld member 20 comprises a proximal end 20*a* and a distal end 20*b*. The proximal end 20*a* comprises an aperture 20*c*. The aperture 20*c* fluidly communicates with the distal end 20*b* of the first handheld member 20 via a conduit 70 (FIG. 1*b*). The first handheld member 20 comprises an annular hollow region 20*d* which extends from the distal end 20*b* towards the proximal end 20*a*.

The first mounting member 21 is substantially cylindrical. The first mounting member 21 comprises a first end 21*a* and a second end 21*b*. The first mounting member 21 is sized and shaped so that the first end 21*a* thereof is receivable within the annular hollow region 20*d* of the first handheld member 20. The second end 21*b* of the first mounting member 21 is configured to be fixedly secured to the housing 8 (e.g. to a hollow portion thereof).

The first driven member 22 comprises a connection end 22*a* and a first engagement portion 22*b* at the end obverse to the connection end 22*a*. The first driven member 22 comprises a substantially central through-hole for receipt of the conduit 70.

A first closure 23 is optionally provided. The first closure 23 may be or comprise a plug. The first closure 23 is configured (e.g. sized and/or shaped) to fit into the aperture 23*c*, for example to provide a fluid tight seal therein. The first closure 23 (or at least a part thereof) may be formed or manufactured from an at least partially ductile material, for example a rubber material. Alternatively, the first closure 23 may be formed from a rigid plastic material. The first closure 23 is provided with a fluid egress aperture 24 which fluidly communicates with conduit 70.

Figure 4A:
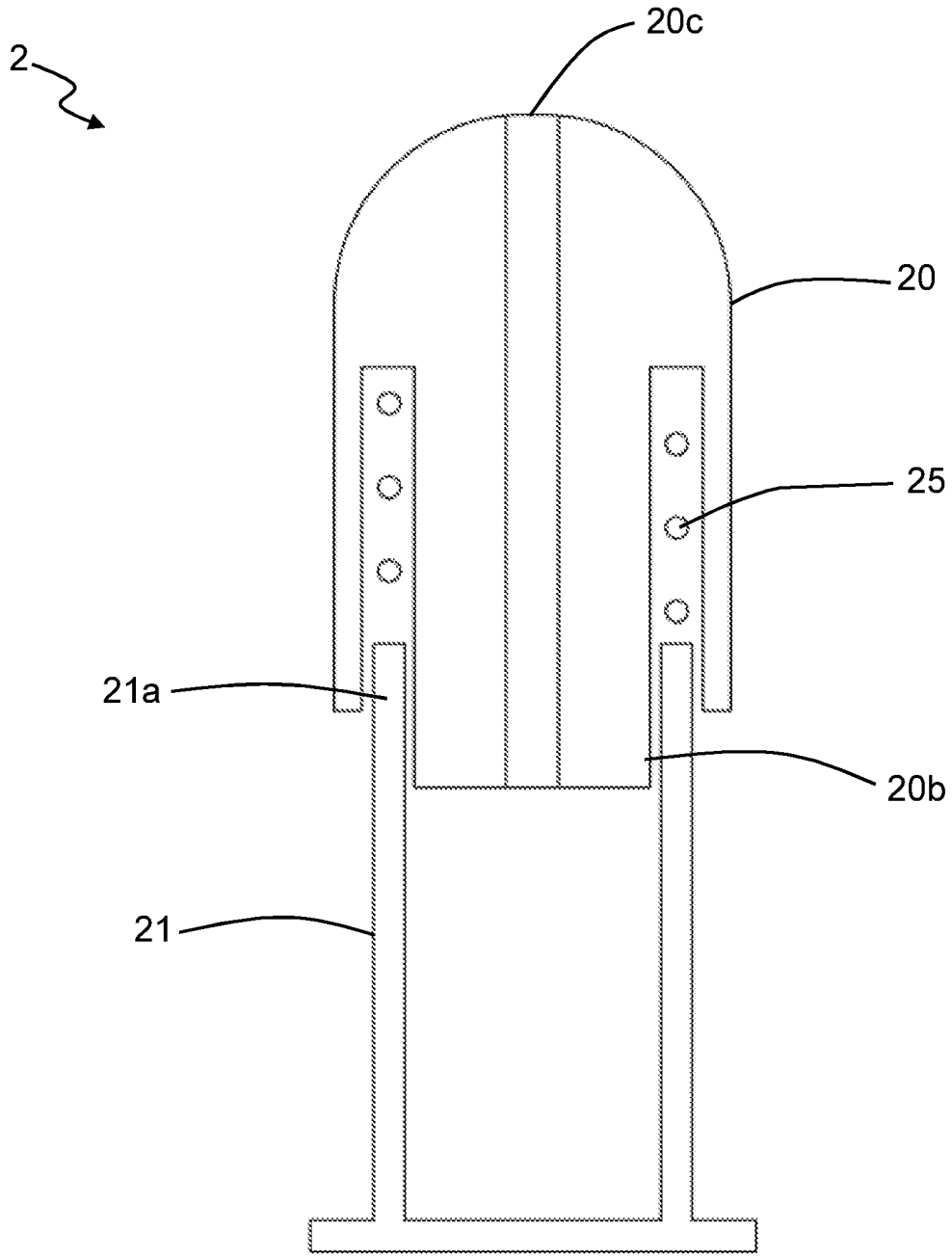
FIG. 4*a* is a partial cross-section of the first actuator from FIG. 1*b* in an assembled state.

As shown in FIG. 4*a*, an urging member 25 (for example a compression spring 25) is located within the first handheld member 20 to bear against the first mounting member 21, whereby the first handheld member 20 is urged towards an extended position distant from the housing 8 and may be resiliently forced towards the housing against the urging of the urging member. Accordingly, the equilibrium position of the first handheld member 20 is in the extended position.

As can be seen in FIG. 1*b*, when assembled the first mounting member 21 is partially received within the first handheld member 20 and the body portion 22*a* of the first driven member 22 is attached to the distal end 20*b* of the first handheld member 20.

The second actuator 3 is similar to the first actuator with similar features having corresponding similar reference numbers (albeit preceded by a '3' instead of a '2'). For the sake of conciseness the similar features of the second actuator 3 will not be described herein. The second actuator 3 differs from the first actuator 2 in that the second driven member 32 comprises not only a second engagement portion 32*b* but also a second biasing member 32*c*.

In use, the first handheld member 20 is reciprocally slideable along the first mounting member 21 to reciprocate the driven member 22 into and away from the housing 8, against and with the urging of the urging member 25. In use, the second handheld member 30 is reciprocally slideable along the second mounting member 31 to reciprocate the second driven member 32 into and away from the housing 8 against the urging of its urging member.

Reservoir 4

Figure 5:
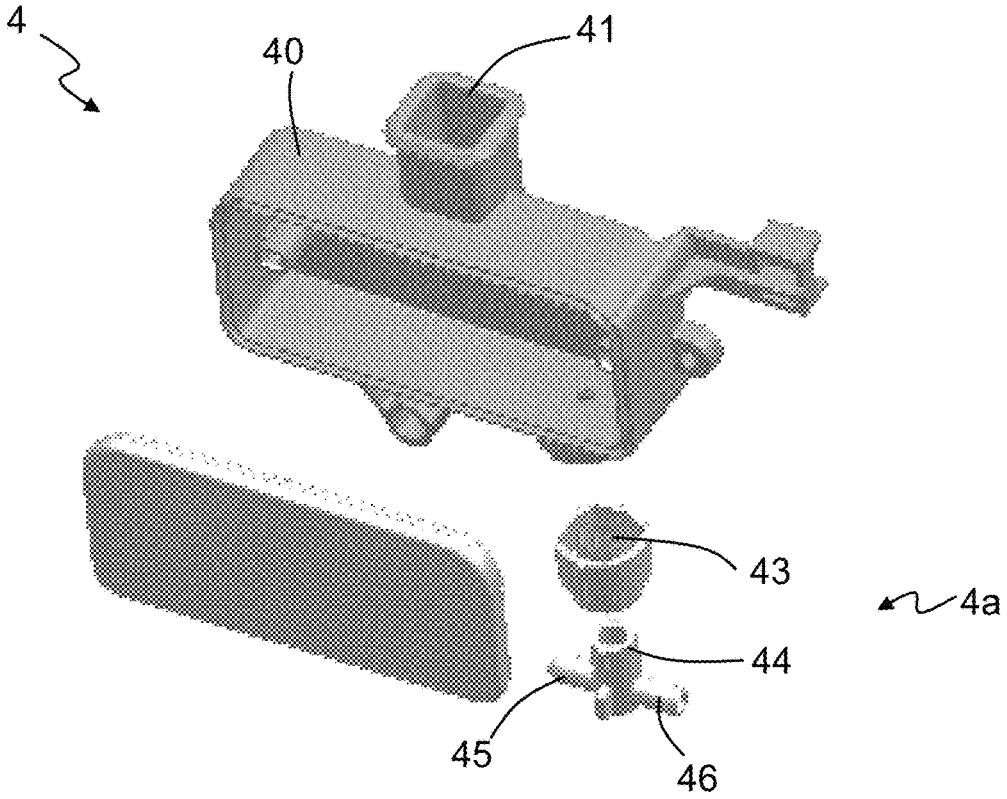
FIG. 5 is a close-up view of FIG. 3, showing the reservoir.

Referring now to FIG. 5, the reservoir 4 comprises an enclosed chamber 40 configured to retain fluid. The reservoir 4 may be refillable. The reservoir 4 may comprise a refill aperture 41. The reservoir 4 may comprise a refill closure 42 (as shown in FIG. 1*b*). The refill closure 42 may be configured (e.g. shaped and/or sized) to sealably close the refill aperture. The refill closure 42 (or at least a part thereof) may be formed or manufacture from an at least partially ductile material, for example a rubber material. The fluid retained in the reservoir 4 may be any suitable fluid. For example, the fluid may be a liquid or a gas. Where the fluid is a liquid, the liquid may be or comprise water, alcohol, one or more colourant and/or flavourant, or the like.

The reservoir 4 comprises a delivery mechanism 4*a*. The delivery mechanism 4*a* comprises a one-way valve 43, a delivery chamber 44, an inlet 45 and an outlet 46. The delivery chamber 44 is in fluid communication with the chamber 40 of the reservoir 4 via the one-way valve 43. The one-way valve 43 is configured (e.g., positioned and sized) so as to allow fluid flow from the chamber 40 of the reservoir 4 to the delivery chamber 44. The one-way valve 43 is configured (e.g., positioned and sized) so as to prevent fluid flow from the delivery chamber 44 to the chamber 40 of the reservoir 4. The delivery chamber 44 is sized to allow, in use, a predetermined volume of fluid from the chamber 40 of the reservoir 4 to be delivered. The inlet 45 and the outlet 46 are each in fluid communication with the delivery chamber 44.

Determination Mechanism 5

Figure 3:
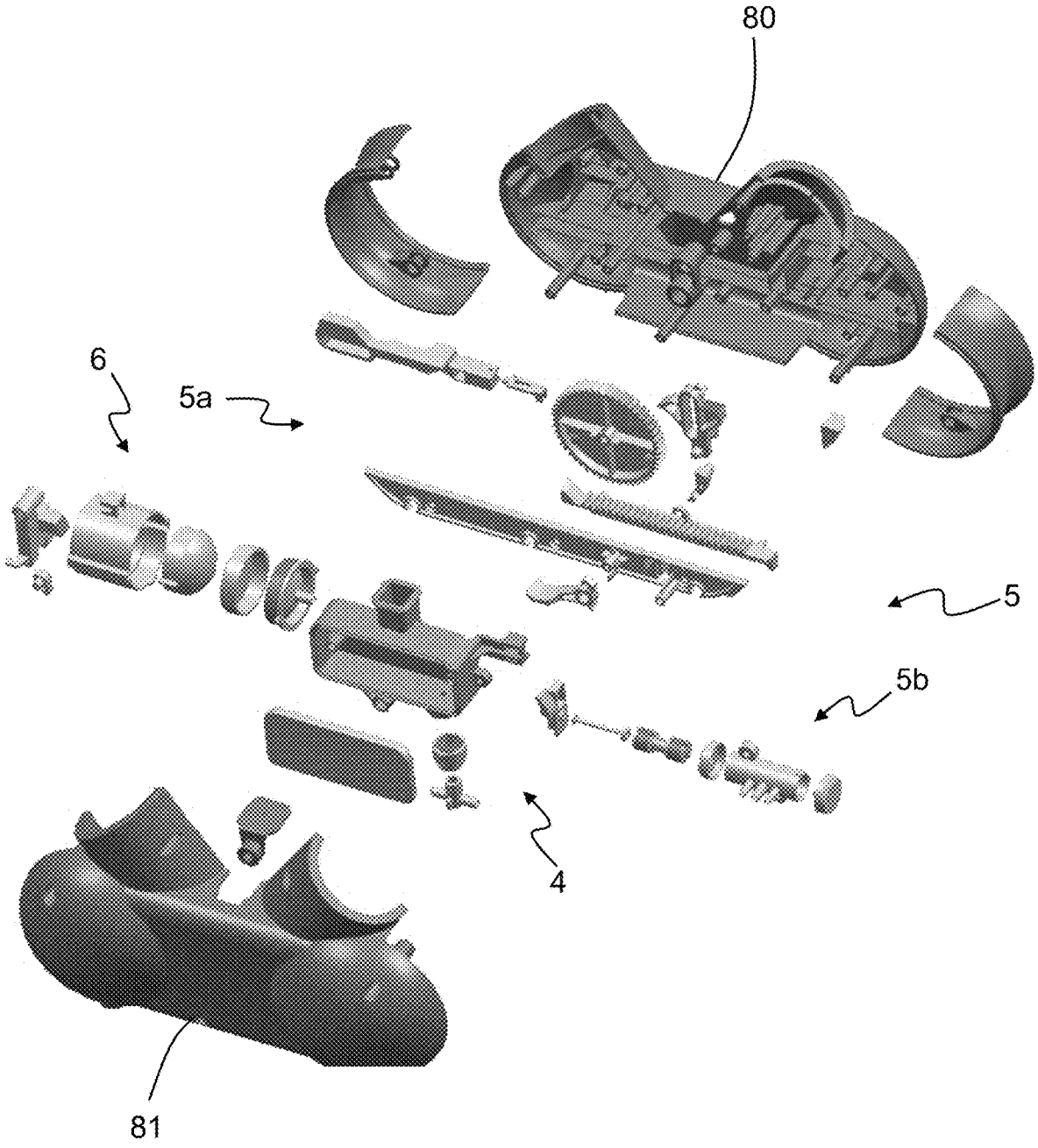
FIG. 3 is an exploded schematic view of some of the components shown in FIG. 2.

Referring to FIG. 3, the determination mechanism 5 comprises a fluid release determination mechanism 5*a* and a direction determination mechanism 5*b*.

Fluid Release Determination Mechanism 5*a*

The fluid release determination mechanism 5*a* is configured to drive or allow, in use, release of fluid from the reservoir 4, for example upon actuation of one or both of the actuators 2, 3 (e.g., a pre-set number of times). The triggering of the release of fluid is indexed, in this example.

The fluid release determination mechanism 5*a* comprises an indexing member 50, a slidable member 51, a rail 52, a driving member 53, a biaser 54, a non-slip mechanism 55 and a biasing member 56.

Figure 6:
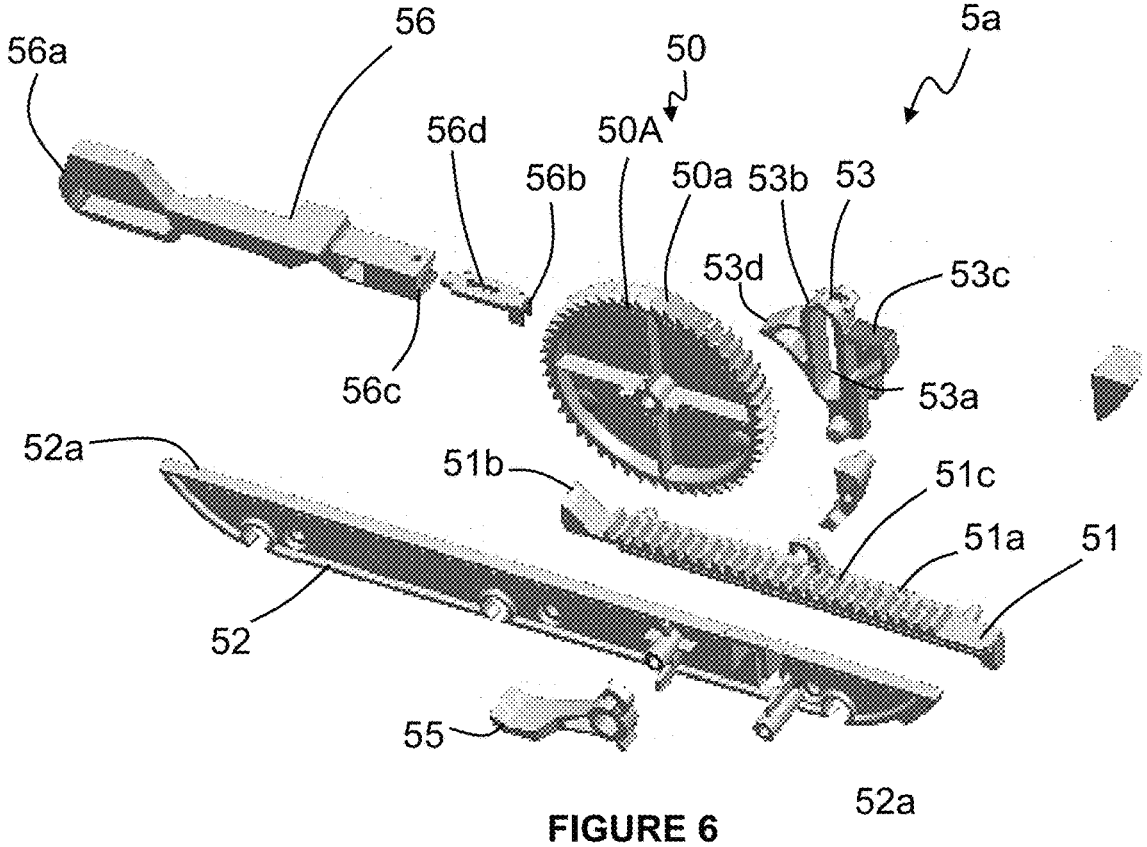
FIG. 6 is a close-up view of FIG. 3, showing the fluid release mechanism.
Figure 6A:
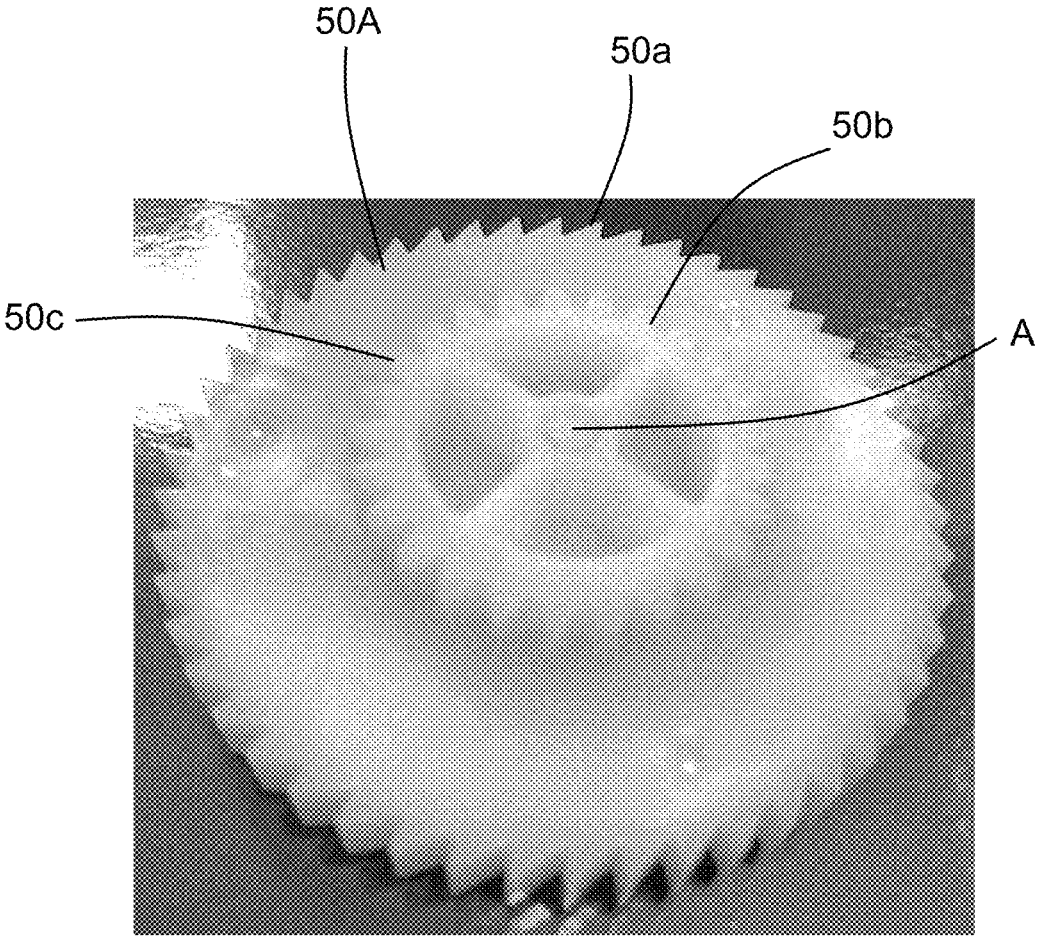
FIG. 6*a* is a side view of the obverse side of the gear of the fluid release mechanism.

The indexing member 50 comprises a gear 50A in this example. The gear 50A has a generally circular shape. The gear 50A may be or comprise a pinion gear. The gear 50A comprises a first set of teeth 50*a* around its outer circumference. As shown in FIG. 6*a*, the gear 50A comprises a projection 50*b* from one of its major surfaces. The projection 50*b* is generally circular. A second set of teeth 50*c* are provided around the circumference of the projection 50*b*. The gear 50A and its projection 50*b* share the same central axis A of rotation. The gear 50A is rotatable, in use. The gear 50A is rotatably secured to the housing 8, for example through its axis A.

The slidable member 51 is elongate. In this example the slidable member 51 comprises or is a rack gear 51. The slidable member 51 comprises a first major surface 51*c*, for example, which is flat (e.g. substantially). A set of teeth 51*a* is provided on the first major surface 51*c* of the slidable member 51. The set of teeth 51*a* of the slidable member are configured to cooperate, in use, with the second set of teeth 50*c* of the indexing member 50. The slidable member 51 has a second major surface, obverse to the first major surface 51*c*. The second major surface is configured to slidably engage with the rail 52, in use. The slidable member 51 comprises an abutment 51*b* at a first end thereof. The slidable member 51 is engaged by a resilient biaser 52*c* to resiliently urge slidable member 51 towards a first end 52*b* of the rail 52 (as shown in FIG. 8*b*).

The rail 52 is elongate. The rail 52 comprises an elongate slide surface 52*a*. The elongate slide surface 52*a* is configured to slidably support the slidable member 51, in use. The rail 52 is secured, in use, to the housing 8, for example using one or more securements (such as screws or the like).

The indexing member 50 is configured to slide the slidable member 51 along the rail 52 by a predetermined distance, in use. The indexing member 51 and the slidable member 52 are located (e.g. secured to the housing 8) such that the first set of teeth 50*a* of the gear 50A engage with the set of teeth 51*a* of the slidable member 51.

The driving member 53 comprises an elongate slot 53*a* therethrough. The driving member 53 comprises a first abutment surface 53*b* on a first side thereof. The driving member 53 comprises a second abutment surface 53*c* on a second side, obverse to the first side. The driving member 53 is slidably attached to the housing 8 by one or more attachments extending through its elongate slot 53*a*. The driving member 53 is slidable, in use, relatively toward the slidable member 51, e.g. in a direction substantially perpendicular to the first major surface of the slidable member 51. The driving member 53 is secured to the housing 8 adjacent the indexing member 50. The driving member 53 is arranged (e.g. shaped and/or sized) to selectively move or drive the indexing member 50. The driving member 53 comprises a catch 53*d*. The catch 53*d* is or comprises a projection from the driving member 53 (e.g. from a main or major body thereof), in this example. The catch 53*d* is arranged or configured to selectively engage with the indexing member 50. The driving member 53 is located so that the catch 53*d* selectively engages with the first set of teeth 50*a* of the indexing member 50 via its lowermost driving surface 53*e* (see FIG. 11).

Figure 9:
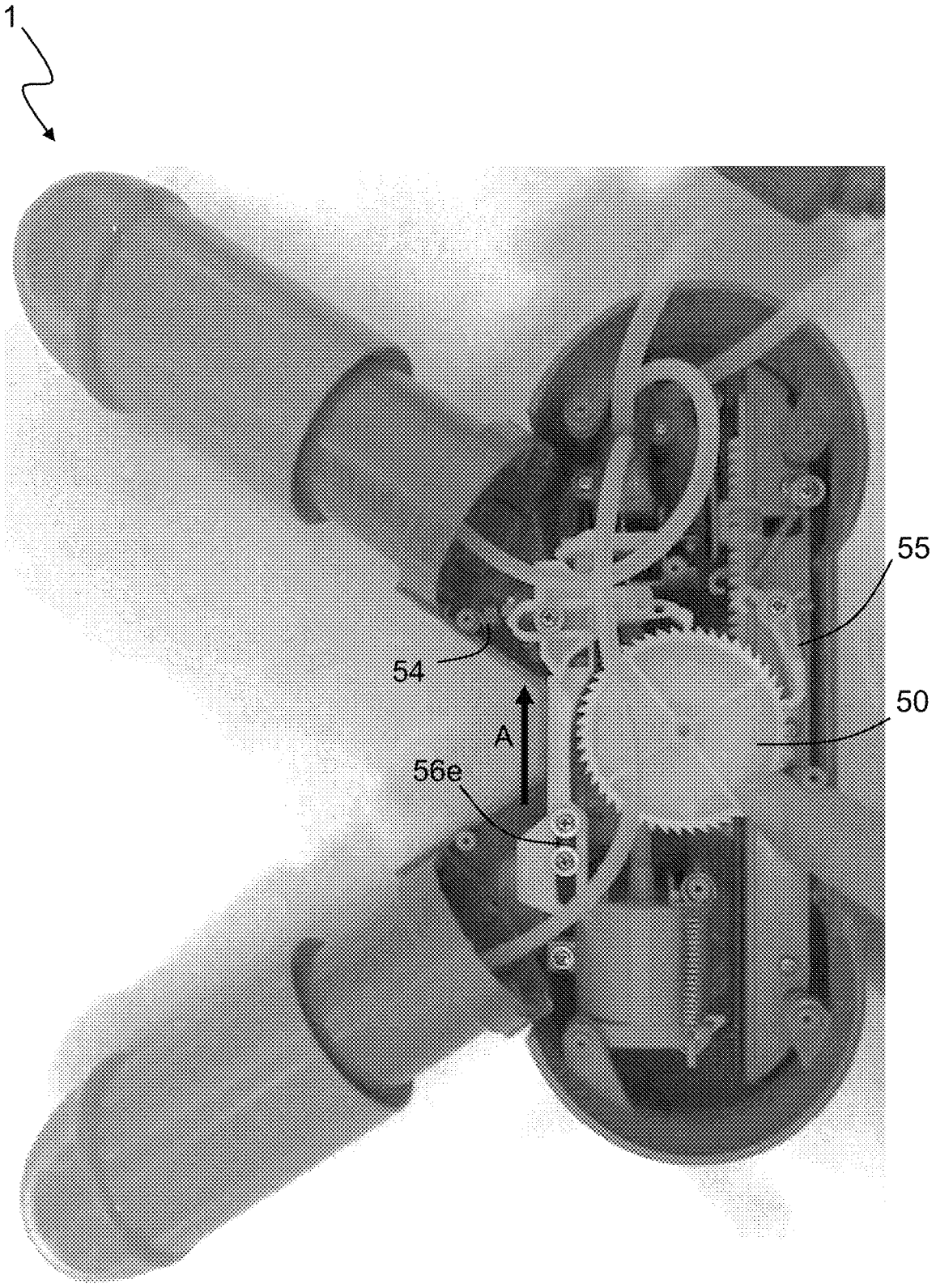
FIG. 9 is a side view of the interactive toy shown in FIG. 1*b* prior to actuation.

The biaser 54 (as shown in FIG. 9) is configured to resiliently bias the driving member 53 relatively away from the slidable member 51 (e.g. in a direction substantially perpendicular to the slidable member 51, for example to the first major surface thereof). The biaser 54 is a tension spring, in this example. However, in examples the biaser 54 may be any suitable mechanism for resiliently biasing the driving member 53 relatively away from the slidable member 51 (e.g. in a direction substantially perpendicular to the first major surface thereof).

The non-slip mechanism 55 may be configured to prevent or restrict the indexing member 50 from movement in at least one direction. For example, the non-slip mechanism 55 may be configured to prevent or restrict the gear 50A from rotating in one direction (e.g. an anti-clockwise direction). The non-slip mechanism 55 may be arranged in a first position or condition (as shown in FIG. 9). In the first position or condition the non-slip mechanism 55 may be configured to engage with the indexing member 50 (e.g. the gear 50A). In the first position or condition the non-slip mechanism 55 may be configured to prevent or restrict the indexing member 50 from moving in one direction, e.g. to prevent or restrict or restrict the gear 50A from rotating in one direction (e.g. the anti-clockwise direction). The non-slip mechanism 55 may be moveable (e.g. pivotable or slidable) out of the first position or condition. As the gear 50A rotates (in the clockwise direction) it slides over the end of the non-slip mechanism. The non-slip mechanism (e.g. the end thereof) is urged back into engagement with the first set of teeth 50*a* of the gear 50A (e.g. as shown in FIG. 9). The non-slip mechanism 55 may be moveable (e.g. pivotable or slidable) into a second position or condition. As shown in FIG. 8*c*, the axis A of the gear 50A extends from a boss B. A resilient biaser RB (e.g. spring) is located about the boss B. In use, the gear 50A is located on the axis A such that the resilient biaser RB is compressed about the boss B. A push button P (or other activation mechanism) is located on the outside of the housing 8 (as shown in FIG. 1). The push button P is configured to move the boss B, when activated. In use, when an operator of the toy 1 activates the push button P the boss B is displaced relatively toward the gear 50A. The boss B thereby displaces the gear 50A along the axis A, such that the non-slip mechanism 55 no longer engages the first set of teeth 50*a* of the gear 50A (e.g. the non-slip mechanism 55 is moved into the second position). In the second position or condition the non-slip mechanism 55 may not prevent or restrict the gear 50A from rotating in either direction. In the second position or condition the non-slip mechanism 55 may not engage the indexing member 50 (e.g. the gear 50A). In the second position or condition, since the non-slip mechanism 55 does not engage the indexing member 50 then the gear 50A is free to rotate. The resilient biaser 52*c* thereby biases the slidable member 51 towards the first end 52*b* of the rail 52 (as shown in FIG. 8*b*). The non-slip mechanism 55 may be biased (e.g. resiliently) towards or into the first position or condition (e.g. by a resilient biaser such as a spring—see FIG. 9).

The biasing member 56 is configured or arranged to selectively drive, in use, the driving member 53 toward the sliding member 51 (under operation of the first actuator 1).

The biasing member 56 is elongate, in this example. The biasing member 56 comprises first and second ends. The biasing member 56 comprises a first abutment 56*a* at the first end. The biasing member 56 comprises a second abutment 56*b* at the second end. Toward the second end but spaced therefrom the biasing member 56 comprises a third abutment 56*c*. The second abutment is at the end of an extension portion 56*d* of the biasing member 56. The extension portion 56*d* of the biasing member 56 extends from adjacent the third abutment 56*c*. The extension portion 56*d* of the biasing member 56 is out of plane with the remaining body of the biasing member 56 (or off-set with respect thereto). A slot 56*e* extends through the biasing member 56 (see FIG. 9). The slot 56*e* extends at least partially along the length of the biasing member 56. In this example, the slot 56*e* is located toward the first end of the biasing member 56. In this example, the slot 56*e* is located spaced from the second end of the biasing member 56. In use, the biasing member 56 is slidably secured to the housing 8. One or more securement slidably secures the biasing member 56 to the housing 8 through the slot 56*e*. In this example, the securement members are screws. However, in examples the securement may comprise any suitable mechanism such as one or more protections from the housing 8, one or more bolts or the like.

The driving member 53 is also selectively driveable, in use, toward the sliding member 51 under operation of the second actuator 3 by engagement of driven member 32 with abutment surface 53*c*.

Direction Determination Mechanism 5*b*

Figure 7:
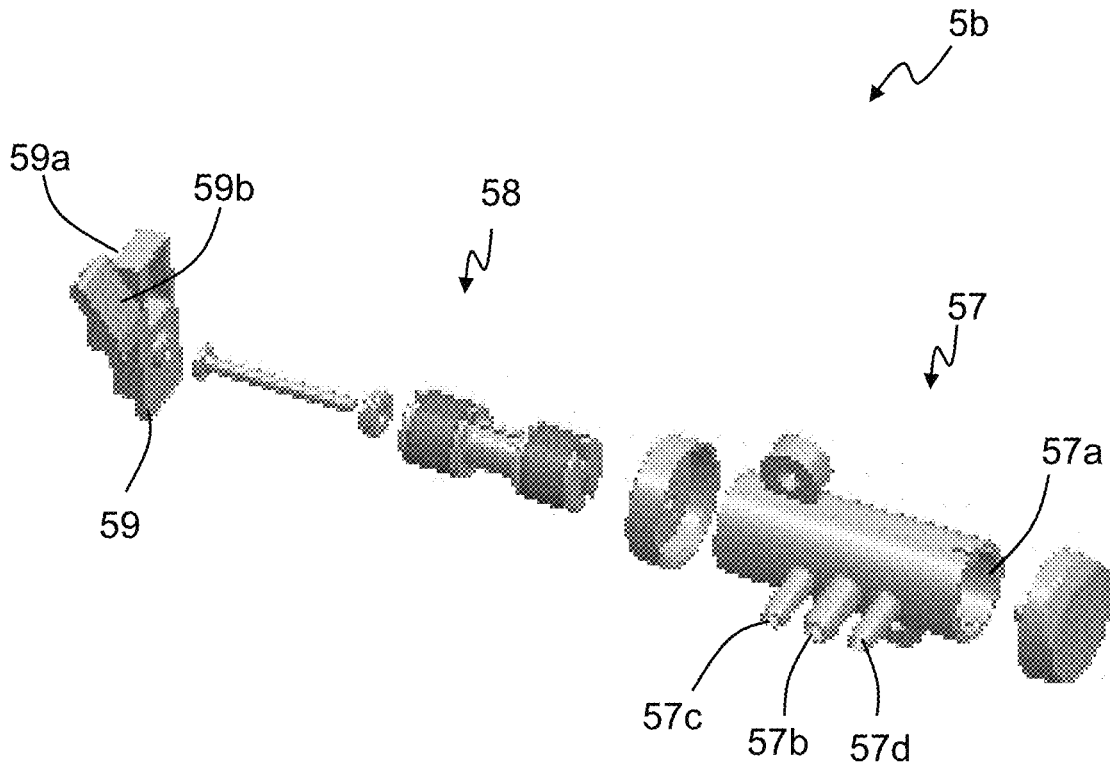
FIG. 7 is a close-up view of FIG. 3, showing the direction determination mechanism.

Referring to FIG. 7, the direction determination mechanism 5*b* is configured to determine, in use, the direction of flow of fluid from the reservoir 4 (e.g. to the first actuator 2 or the second actuator 3).

The direction determination mechanism 5*b* comprises a manifold 57, a valve 58, and a valve moving member 59.

The manifold 57 comprises a chamber 57*a*, an inlet 57*b* and first and second outlets 57*c*, 57*d*. The inlet 57*b* and first and second outlets 57*c*, 57*d* are each in fluid communication with the inside of the chamber 57*a*.

The valve 58 is configured (e.g. shaped and/or sized) to slidably fit within the manifold 57. The valve 58 is moveable (e.g. translatable or slidable), in use, between a first position and a second position in the manifold 57. In the first position the valve 58 is configured to allow fluid flow from the inlet 57*b* to the first outlet 57*c*. In the first position the valve 58 is configured to prevent fluid flow from the inlet 57*b* to the second outlet 57*d*. In the second position the valve 58 is configured to allow fluid flow from the inlet 57*b* to the second outlet 57*d*. In the second position the valve 58 is configured to prevent fluid flow from the inlet 57*b* to the first outlet 57*c*. The valve 58 may be configured to prevent fluid flow between the first and second outlets 57*c*, 57*d* in the first and/or second positions. The valve 58 may be configured to prevent fluid flow from the inlet 57*b* to both the first and second outlets 57*c*, 57*d* when the valve 58 is not in the first or the second position.

The valve moving member 59 is attached to the valve 58, e.g. to or at a free end thereof. The valve moving member 59 comprise a first abutment surface 59*a* and a second abutment surface 59*b*. The first abutment surface 59*a* is on a first side of the valve moving member 59. The second abutment surface 59*b* is on an obverse side of the valve moving member 59 to the first side.

The biasing member 56 (as described above with respect to the fluid release determination mechanism 5*a*) is configured or arranged to selectively bias, in use, the valve 58 (e.g. via the valve moving member 59) to or toward the second position.

Pressurizing Mechanism 6

Figure 8:
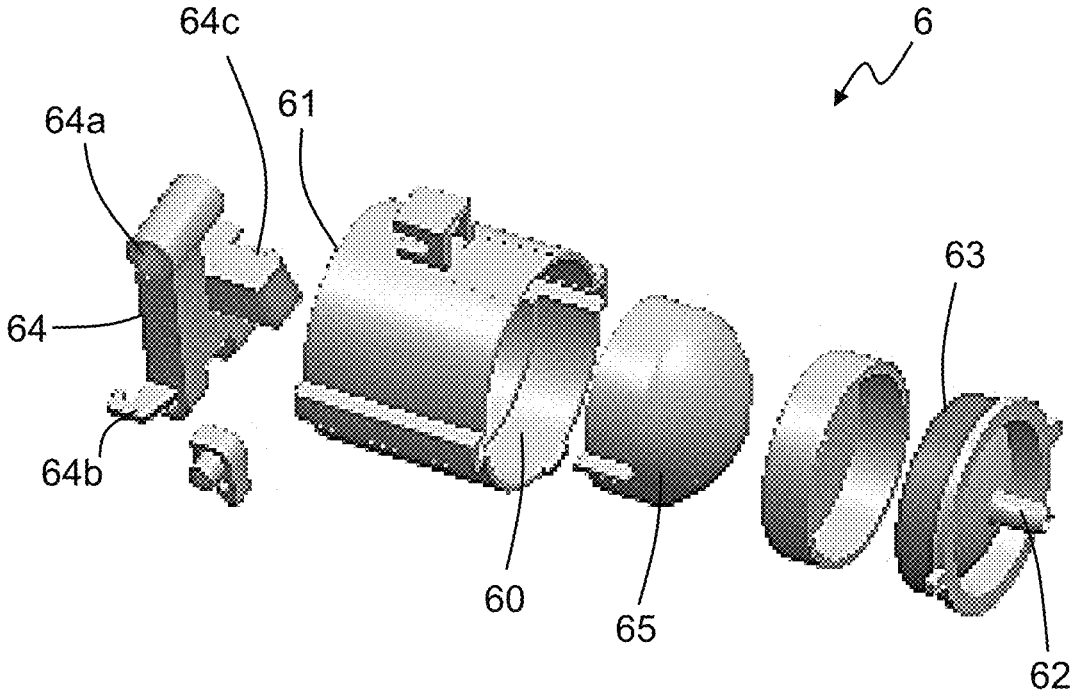
FIG. 8 is a close-up view of FIG. 3; showing the pressurization mechanism.
Figure 8A:
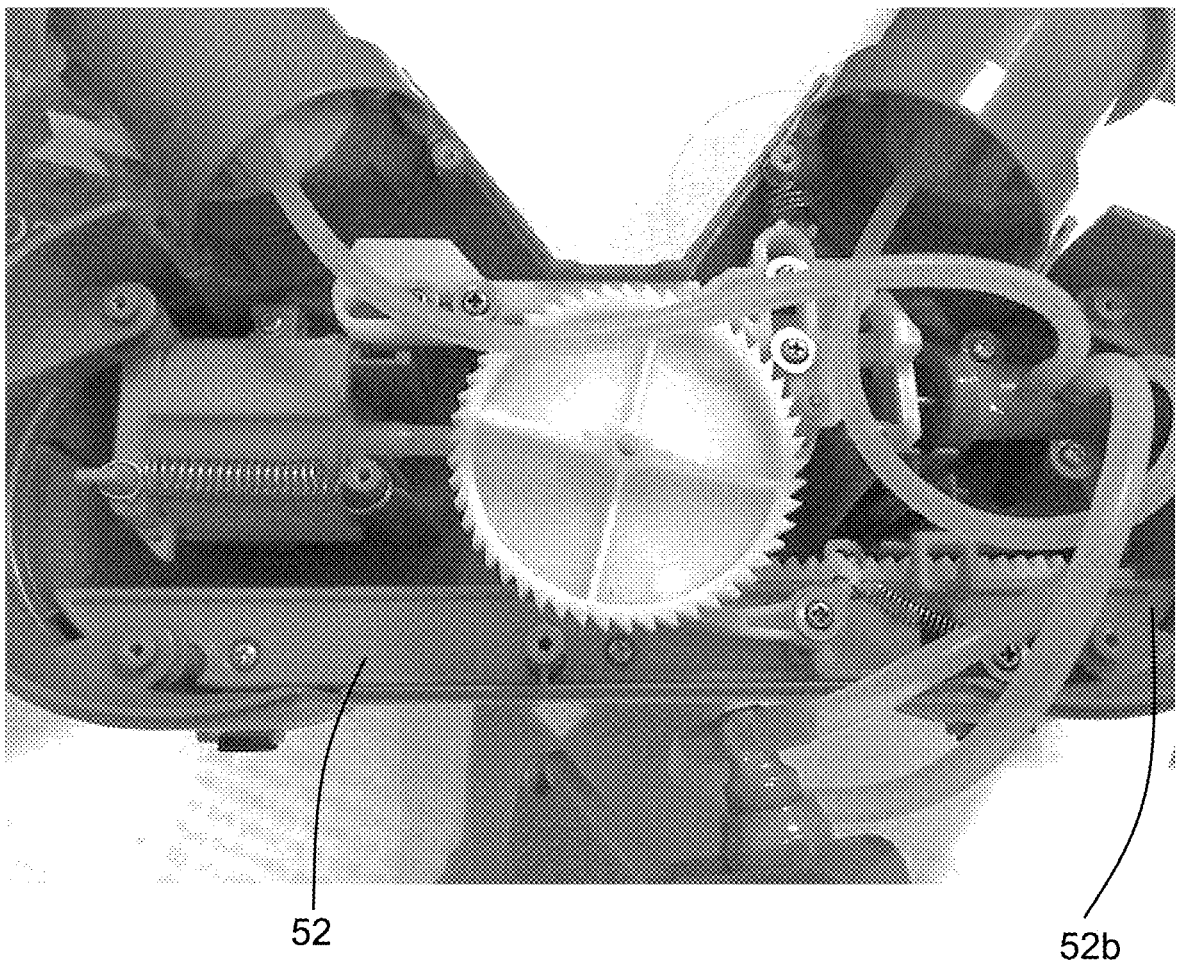
FIG. 8*a* is a partial side view of the interactive toy shown in FIG. 1*b* in a partially disassembled state.
Figure 8B:
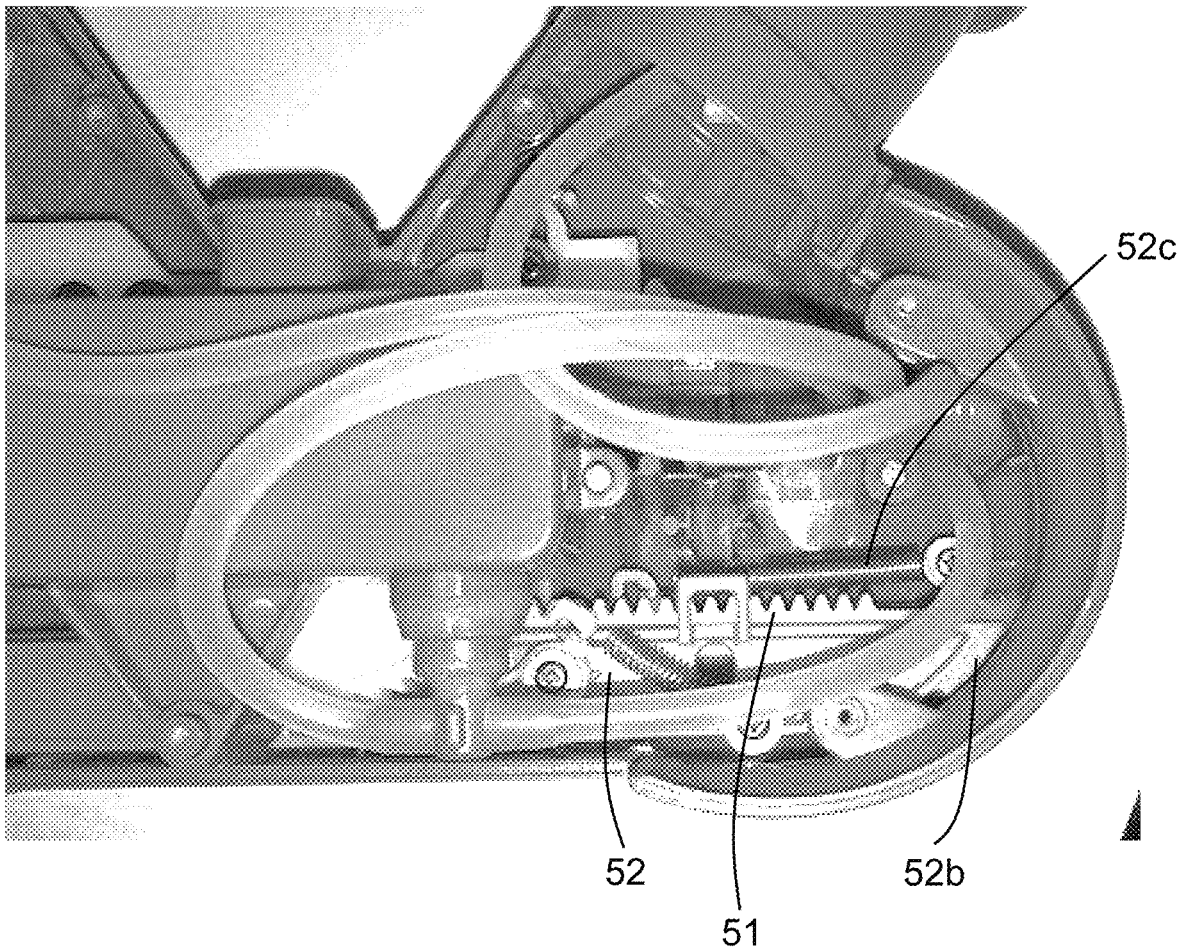
FIG. 8*b* is a partial side view of the interactive toy shown in FIG. 1*b;*
Figure 8C:
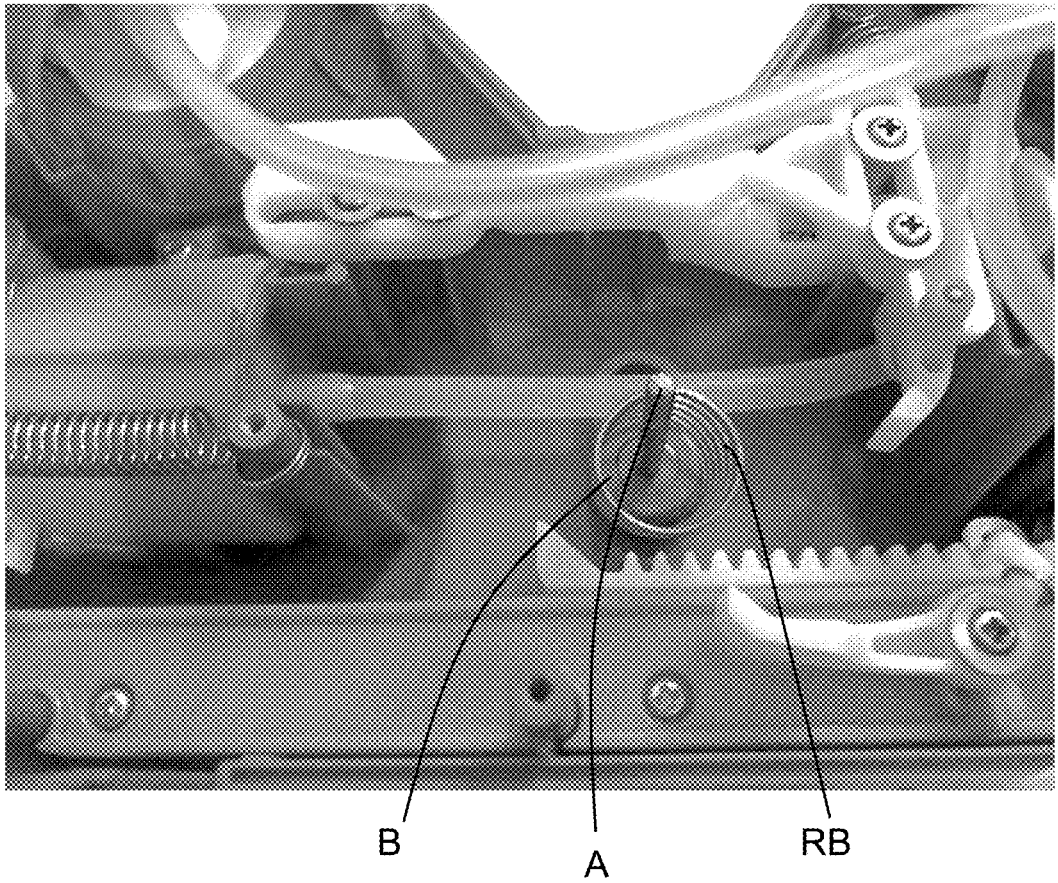
FIG. 8*c* is a partial side view of the interactive toy shown in FIG. 1*b* with the gear removed.

Referring to FIG. 8, the pressurizing mechanism 6 is configured to selectively draw or drive fluid from the reservoir 4, for example to the direction determination mechanism 5*b*.

The pressurizing mechanism 6 comprises a chamber 60, an inlet 61, an outlet 62, a non-return valve 63, a flap 64 and a diaphragm 65.

The outlet 62 and inlet 61 fluidly communicate with the chamber 60. The diaphragm 65 is located within the chamber 60, in use. The diaphragm 65 separates the outlet 62 from the inlet 61. The diaphragm 65 is moveable between first and second conditions. In the first condition the diaphragm 65 defines or provides a relatively greater volume between itself and the outlet 62 than it does when in the second condition. The diaphragm 65 is resiliently biased toward the first condition. The diaphragm 65 may be at least partially formed from a resilient material. The diaphragm 65 may be configured (e.g. shaped) to resiliently bias itself toward the first condition. In examples, the diaphragm 65 may flex or otherwise deform (e.g. moving between the first and second condition). For example, the diaphragm 65 or at least a portion thereof may be formed from a flexible material. The diaphragm 65 is fluidly sealed to the inside of the chamber 60. The flap 64 is positioned or arranged to selectively close the inlet 61 of the pressurizing mechanism 6. In a first position or condition the flap 64 is configured to close (e.g. sealably) the inlet 61 of the pressurizing mechanism 6. The flap 64 is resiliently biased (e.g. by a biaser such as a spring 64*d* as shown in FIG. 1*b*) into or toward the first position or condition. The flap 64 is movable to or toward a second position or condition. In the second position or condition the flap 64 is open, e.g. such that the inlet 61 of the pressurizing mechanism 6 is open. The flap 64 is pivotable, for example about a hinge 64*a*. The hinge 64*a* is provided at a first side or end of the flap 64. The flap 64 comprises an abutment 64*b*. The abutment 64*b* is provided at a second side or end of the flap 64, obverse to the first side or end of the flap 64. The flap 64 comprises a projection 64*c* extending from a major surface thereof. The projection 64*c* is configured (e.g. sized and shaped) to engage with the diaphragm 65 when the flap 64 is in the first position or condition. When the flap 64 is in the second position or condition the projection 64*c* is not engaged with the diaphragm 65.

Conduits 7

Referring to FIG. 1*b*, the plural conduits 7 comprise a first outlet conduit 70, a second outlet conduit 71, a first inlet conduit 72 and a second inlet conduit 73.

The first outlet conduit 70 is fluidly connected at one of its ends to the first outlet 57*c* of the manifold 57. The first outlet conduit 70 is fluidly connected at its other end to the aperture 20*c* through the proximal end 20*a* of the first handheld member 20.

The second outlet conduit 71 is fluidly connected at one of its ends to the second outlet 57*d* of the manifold 57. The second outlet conduit 71 is fluidly connected at its other end to the aperture 30*c* through the proximal end 30*a* of the second handheld member 30.

The first inlet conduit 72 fluidly connects the outlet 62 of the pressurizing mechanism 6 to the inlet 45 of the reservoir 4. The second inlet conduit 73 fluidly connects the outlet 46 of the reservoir to the inlet 57*b* of the manifold 57.

The plural conduits 7 are tubes in this example. The plural conduits 7 may be formed from an at least partially ductile material. One, some or each of the plural conduits 7 may be connected or attached to the inlets and/or outlets via friction fit. Additionally or alternatively, one, some or each of the plural conduits 7 may be adhered to the inlets and/or outlets (and/or otherwise secured thereto).

Housing 8

Figure 2:
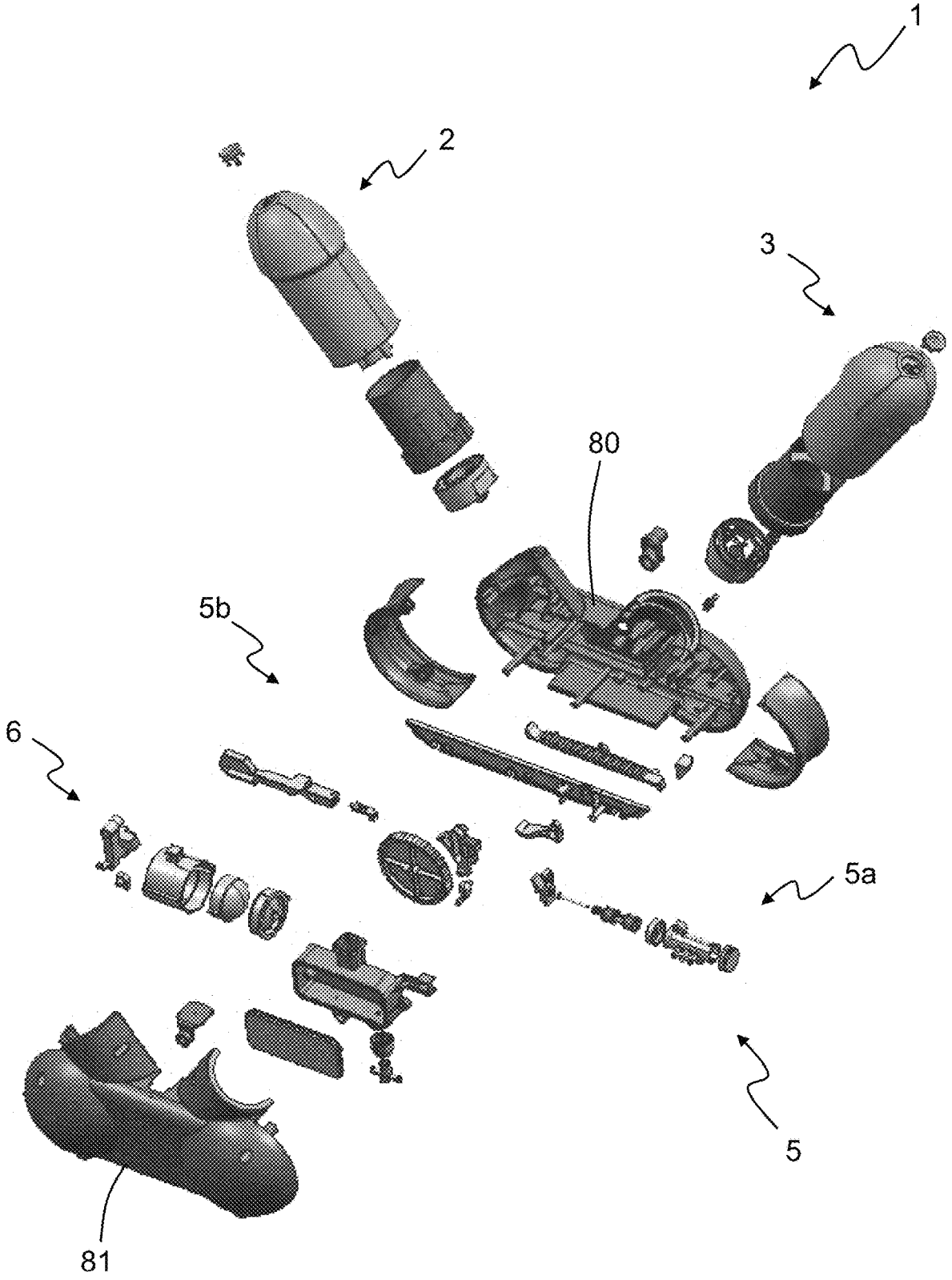
FIG. 2 is an exploded schematic view of the interactive toy shown in FIG. 1*b*, with the cover included.

The housing 8 is configured (e.g. sized and/or shaped) to retain the reservoir 4, the determination mechanism 5, the pressurizing mechanism 6 and the conduits 7. The housing 8 is a clamshell arrangement, in this example. The housing 8 comprises a base portion 80 and a cover 81 (as shown in FIG. 2).

One, some or each of the reservoir 4, the determination mechanism 5 (e.g. many or all of the components thereof) and the pressurizing mechanism 6 (e.g. many or all of the components thereof) may be formed of a plastics material.

Operation

In use, the interactive toy 1 is fully assembled prior to use. The gear 50A is rotatably secured to the housing 8 such that the second set of teeth engage with the set of teeth 51*a* of the slidable member 51.

A first operator operates the first actuator 2 and a second operator operates the second actuator 3.

Figure 10:
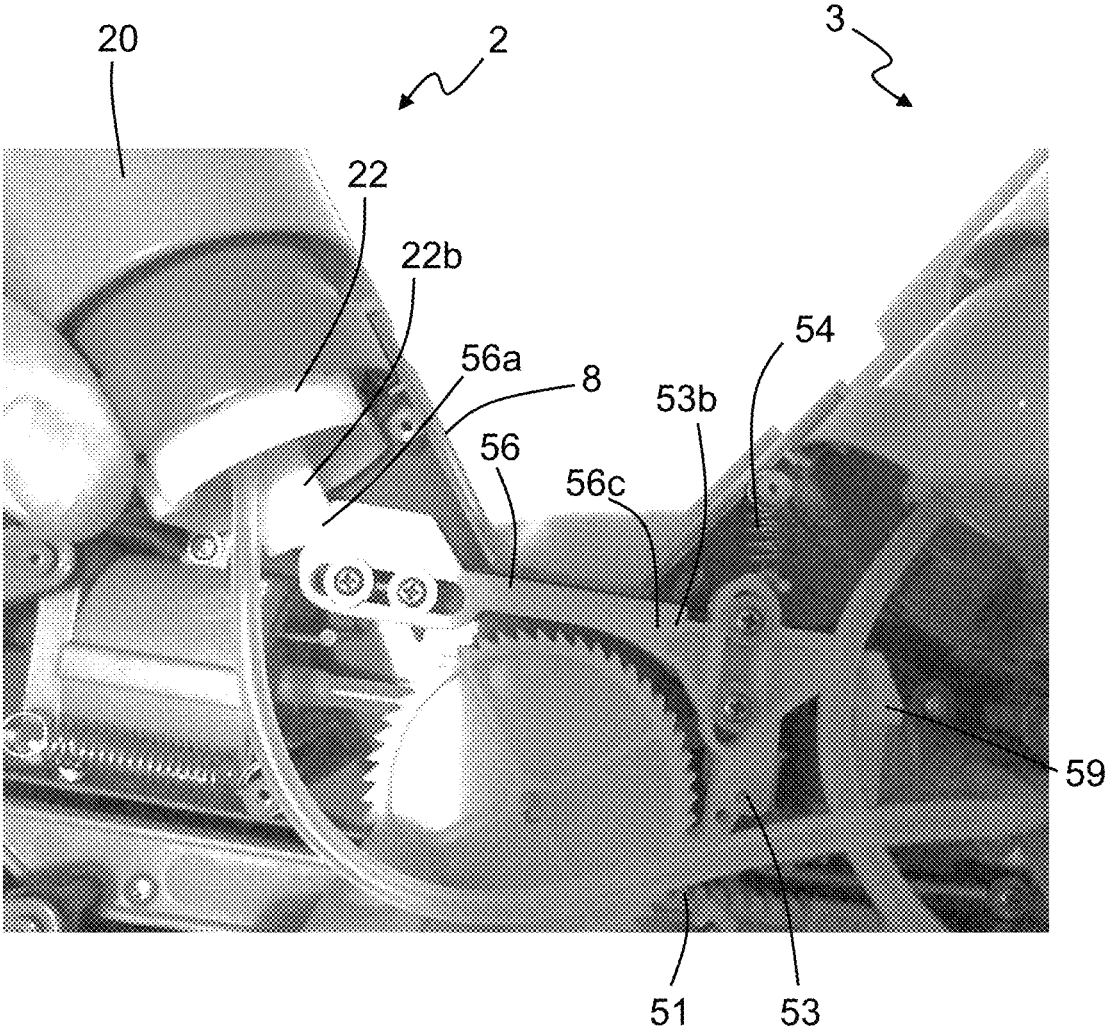
FIG. 10 is a partial side view of the interactive toy shown in FIG. 1*b* when the first actuator has been actuated.

Referring now to FIG. 10, the first operator grips the first handheld member 20 in their hand, in use. When the first operator pushes the first handheld member 20 toward the housing 8 this movement causes the first driven member 22 to be moved relatively into the housing 8. This movement causes the first engagement portion 22*b* of the first driven member 22 to engage with the first abutment 56*a* of the biasing member 56 (as shown in FIG. 10). Further movement of the first handheld member 20 toward the housing 8 causes the first engagement portion 22*b* of the first driven member 22 to push the biasing member 56. The biasing member 56 is thereby caused to slide toward the driving member 53 (e.g. in direction A as shown in FIG. 9). The second abutment 56*b* at the second end of the biasing member 56 is thereby caused to engage with the first abutment surface 59*a* of the valve moving member 59 of the fluid release mechanism 5*b*. Continued sliding of the biasing member 56 in direction A causes the second abutment 56*b* of the biasing member 56 to push the valve 58 (via moving the valve moving member 59) into the second position. In the second position the valve 58 allows fluid flow from the inlet 57*b* of the manifold 57 to the second outlet 57*d* thereof but prevents fluid flow from the inlet 57*b* to the first outlet 57*c*.

Simultaneous with the biasing of the valve 58 into the second position, sliding of the biasing member 56 in direction A causes the third abutment 56*c* of the biasing member 56 to engage with the first abutment surface 53*b* of the driving member 53. Continued sliding of the biasing member 56 in direction A causes the driving member 53 to be driven relatively toward the slidable member 51 (e.g., against the action of the biaser 54).

In examples, the biasing member 56 slides in a direction substantially perpendicular to the direction in which the driving member 53 is driven. The biasing member 56 and/or the driving member 53 are configured to translate the direction of sliding of the biasing member 56 into the direction in which the driving member 53 is driven. In examples, the third abutment 56*c* of the biasing member 56 is sloped relative to the direction in which it is slid, in use. In examples, the first abutment surface 53*b* of the driving member 53 is sloped relative to the direction in which it is driven, in use. The slopes of the third abutment 56*c* and the first abutment surface 53*b* are configured to cooperate with one another, in use.

Movement of the driving member 53 toward the slidable member 51 causes the end 53*e* of the catch 53*d* to push the gear 50A to rotate about its axis. The gear 50A is caused to rotate by a single tooth's distance of the first set of teeth 50*a*. Rotation of the gear 50A causes the second set of teeth about the projection to also rotate. The second set of teeth of the gear 50A are engaged with the set of teeth 51*a* of the slidable member 51. Accordingly, the slidable member 51 is caused to slide along the rail 52. The slidable member 51 slides along the rail by a distance equivalent to a single tooth of the first set of teeth 50*a* of the gear 50A.

The first operator then moves the first handheld member 20 back away from the housing 8. The biaser 54 causes the driving member 53 to move back, relatively away from the slidable member 51. This movement of the driving member 53 forces the biasing member 56 to also be slide back, in the direction opposite to direction A.

Subsequent movement of the first handheld member 20 toward the housing 8 by the first operator begins the cycle again and results in the slidable member 51 being moved along the rail 52 by another tooth's distance and also by the valve 58 being moved into or kept in the second position.

Operation of the second actuator 3 is now described.

Figure 11:
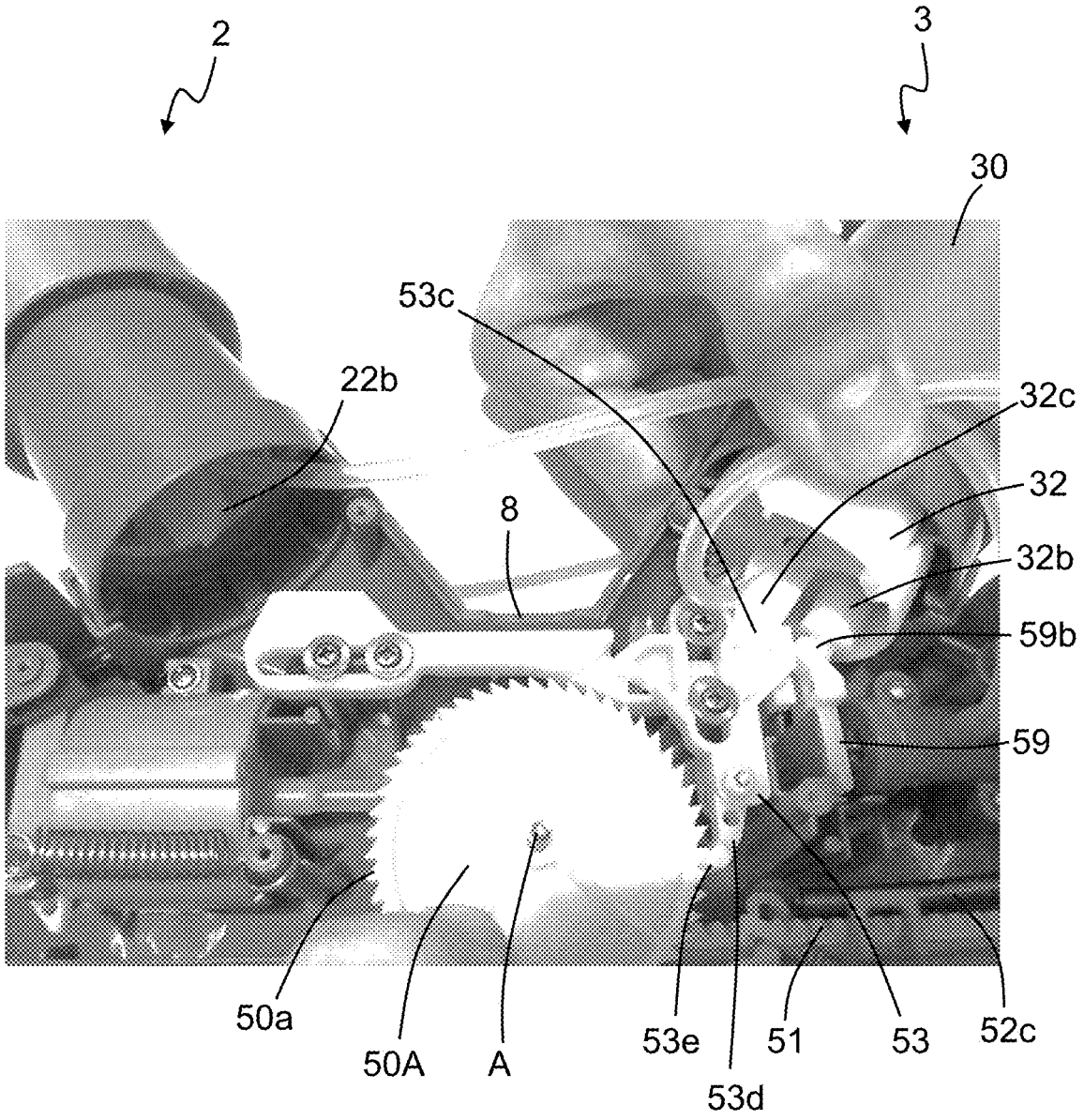
FIG. 11 is a partial side view of the interactive toy shown in FIG. 1*b* when the second actuator has been actuated.

The second operator grips the second handheld member 30 in their hand, in use. When the second operator pushes the second handheld member 30 toward the housing 8 this movement causes the second driven member 32 to be moved relatively into the housing 8. This movement causes the second engagement portion 32*b* of the second driven member 32 to engage with the second abutment surface 59*b* of the valve moving member 59 of the fluid release mechanism 5*b* (as shown in FIG. 11). Continued movement of the second handheld member 30 toward the housing 8 causes the second engagement portion 32*b* of the second driven member 32 to push the valve 58 (via moving the valve moving member 59) into the first position. In the first position the valve 58 allows fluid flow from the inlet 57*b* of the manifold 57 to the first outlet 57*c* thereof but prevents fluid flow from the inlet 57*b* to the second outlet 57*d*.

Simultaneous with the biasing of the valve 58 into the first position, movement of the second handheld member 30 toward the housing 8 causes the second biasing member 32*c* to engage with the second abutment surface 53*c* of the driving member 53 (as shown in FIG. 11). Continued movement of the second handheld member 30 toward the housing 8 causes the second biasing member 32*c* to push the driving member 53 relatively toward the slidable member 51 (e.g. against the action of the biaser 54). Movement of the driving member 53 toward the slidable member 51 causes the catch 53*d* to push the gear 50A to rotate about its axis. The gear 50A is caused to rotate by a single tooth's distance of the first set of teeth 50*a*. Rotation of the gear 50A causes the second set of teeth about the projection to also rotate. The second set of teeth of the gear 50A are engaged with the set of teeth 51*a* of the slidable member 51. Accordingly, the slidable member 51 is caused to slide along the rail 52. The slidable member 51 slides along the rail by a distance equivalent to a single tooth of the first set of teeth 50*a* of the gear 50A.

The second operator then moves the second handheld member 30 back away from the housing 8. The biaser 54 causes the driving member 53 to move back, relatively away from the slidable member 51.

Subsequent movement of the second handheld member 30 toward the housing 8 by the second operator begins the cycle again and results in the slidable member 51 being moved along the rail 52 by another tooth's distance and also by the valve 58 being moved into or kept in the first position.

In use the first and second handheld members 20, 30 may be reciprocally moved back and forth by their respective operators, for example substantially continuously until the end result is achieved (e.g. fluid is released by the interactive toy 1 from the first or second aperture 20*c*, 30*c*).

Fluid is released from one of the first and second apertures 20*c*, 30*c* when the pressurizing mechanism 6 is caused to drive a quantity of fluid from the reservoir 4.

The fluid release determination mechanism 5*a* is configured (e.g. arranged and sized) such that a predetermined number of actuations of either/both of the first and second actuators 2, 3 causes the slidable member 51 to be slid along the rail 52 into a position whereby the abutment 51*b* at the first end of the slidable member 51 is directly adjacent the abutment 64*b* of the flap 64 of the pressurizing mechanism 6. The next actuation by either of the first or second actuator 2, 3 causes the slidable member 51 to move along the rail 52 again by a further tooth's distance. This movement causes the abutment 51*b* at the first end of the slidable member 51 to engage the abutment 64*b* on the flap 64 of the pressurizing mechanism 6. The one tooth's distance by which the slidable member 51 is slid along the rail 52 causes the flap 64 to pivot about its hinge 64*a* into the second position (whereby the abutment 64*b* of the flap 64 is pushed by the abutment 51*b* of the slidable member 51). The distance by which the slidable member 51 is moved by a single actuation of the first or second actuators 2, 3 is sufficient to both move the flap 64 into the second position or condition (e.g. to open it) and also to move the abutment 51*b* of the slidable member 51 beyond the abutment 64*b* of the flap 64. Accordingly, the flap 64 is able to also return from the second position or condition to the first position or condition (e.g. closed), for example as biased by the biaser 64*d*. The predetermined number of actuations required to cause or allow release of fluid from the reservoir may be any suitable number. In examples, the number may be between about 10 and 200, say between 15, 20, 25, 30, 35, 40 or 45 and 55, 60, 65, 70, 80, 90, 100, 110, 120, 130, 140, 150, 160, 170, 180 or 190. The predetermined number of actuations required to cause or allow release of fluid from the reservoir is defined in part by the number of teeth on the slidable member 51.

When the flap 64 is opened (e.g. in the second condition or position) the projection 64*c* no longer engages the diaphragm 65. The diaphragm 65 is biased (for example by its own resilience) toward its first condition, such that the volume between the diaphragm 65 and the outlet 62 is relatively increase. A relatively reduced pressure is thereby generated on the outlet 62 side of the diaphragm 65. This relatively reduced pressure is transmitted via the first inlet conduit 72 to the inlet 45 of the reservoir 4. Fluid is drawn from the reservoir 4 via this relatively reduced pressure (e.g. into the delivery chamber 44 and/or the first inlet conduit 72 and/or the chamber 60 on the outlet 62 side of the diaphragm 65).

The relatively rapid return of the flap to the first position or condition from the second position or condition causes the projection 64*c* to engage with the diaphragm 65 again, within the chamber 60 of the pressurizing mechanism 6. The diaphragm 65 is biased by this engagement toward the outlet of the pressurizing mechanism 6 (e.g. back into its second condition and against its own resilient biasing). A relatively increased pressure is thereby generated in the portion of the chamber 60 between the diaphragm 65 and the outlet 62. This relatively increased pressure is transmitted via the first inlet conduit 72 to the inlet 45 of the reservoir 4. The fluid which was drawn from the reservoir via the opening of the flap 64 is forced via this increased pressure out of the outlet 46 of the reservoir 4. This fluid is then pushed by this relatively increased pressure via the second inlet conduit 73 to the inlet 57*b* of the manifold 57.

The direction in which the fluid from the reservoir 4 is directed depends on which of the first and second actuators 2, 3 was the last to be actuated. If the first actuator 2 was the last to be actuated and to cause the release of fluid from the reservoir 4 then the fluid is delivered via the valve 58 from the inlet 57*b* of the manifold 57 to the second outlet 57*d* thereof. The fluid then travels through the second outlet conduit 71 to the second aperture 30*c* of the second actuator 3, from which it is ejected. If, however, the second actuator 3 was the last to be actuated and to cause the release of fluid from the reservoir 4 then the fluid is delivered via the valve 58 from the inlet 57*b* of the manifold 57 to the first outlet 57*c* thereof. The fluid then travels through the first outlet conduit 70 to the first aperture 20*c* of the first actuator 2, from which it is ejected.

In examples, when both the first and second actuators 2, 3 are actuated simultaneously, the valve 58 may be moved by the valve moving member 59 into a position between the first and second positions. In this position the valve 58 may prevent fluid from travelling from the inlet 57*b* of the manifold 57 to either the first or second outlet 57*c*, 57*d* thereof. Hence, release of the fluid from the interactive toy 1 may require a subsequent activation of the first or second actuator 2, 3 (for example at a time when the first and second actuators 2, 3 are not actuated simultaneously).

It will be appreciated by those skilled in the art that several variations to the aforementioned examples are envisaged without departing from the scope of the invention. For example, the specific shapes of the actuators 2, 3 and/or the housing 8 need not be as shown in the drawings. Instead, the actuators 2, 3 and/or the housing 8 may have any suitable shape. Indeed, one of the actuators 2, 3 may have a different shape than does the other actuator 2, 3.

Additionally or alternatively, in examples the actuators 2, 3 may not comprise the reciprocating members as shown in the drawings and, instead, a different form of actuator may be provided. For example, one or each actuator 2, 3 may comprise a button or switch or other actuation mechanism (e.g. a user operable actuation mechanism).

Additionally or alternatively, one, some or each of the actuators 2, 3 may comprise a resilient biaser configured to return the actuator to its starting (e.g. extended) position. For example, one, some or each of the actuators 2, 3 may comprise one or more springs (e.g. compression and/or tension).

Additionally or alternatively, in examples, the interactive toy 1 may comprise a, or more than one, power source (for example, electrical power source). In examples, the one or more electrical power source may comprise one or more battery. Where provided the one or more power source may provide energy, in use, to pressurize or move fluid within the toy (e.g. to assist or enhance the movement of fluid within the interactive toy 1). The one or more power source may provide energy (e.g. electrical energy) to a pump or motor, for example configured to pressurize or move fluid within the interactive toy 1. The pump or motor may be configured to drive or pressurize fluid at any suitable point in the interactive toy 1, for example at, upstream or downstream of the pressurizing mechanism 6. For example, operation of the actuators may cause the toy to alter the directional flow of water from the manifold 57, i.e. may bring the first or second actuator 2, 3 into fluid communication with manifold 57 whilst also causing the power source to advance the slidable member 51 or to cause a counter to count actuations whereby when a pre-determined number of actuations has been counted a pump or motor causes fluid to be emitted or ejected from one or other of the actuators 2, 3.

Additionally or alternatively, in examples the interactive toy 1 may not emit fluid (e.g. from the first and/or second apertures 20*c*, 30*c*). Instead, notification that one operator of the actuators 2, 3 may be provided in an alternative manner (for example via visual and/or aural notification). An aural notification may comprise one or more light source being activated (e.g. continuously or intermittently). An aural notification may comprise an audible alarm, music, voice, etc., being emitted. The interactive toy 1 may comprise one or more light source, display (e.g. LED, OLED, LCD, etc.) and/or speaker. Where fluid is not emitted the reservoir, conduits and the like may be omitted from the interactive toy 1. Alternatively, another penalty may be imposed on the losing player.

It will also be appreciated by those skilled in the art that any number of combinations of the aforementioned features and/or those shown in the appended drawings provide clear advantages over the prior art and are therefore within the scope of the invention described herein.

What is claimed is:

1. A toy for use by plural operators, the toy comprising: first and second user-operable actuators; a reservoir for retaining fluid; first and second outlets for emitting fluid from the reservoir to outside of the toy; and a direction determination mechanism; where the direction determination mechanism is configured or configurable, in use, to selectively allow or prevent fluid communication between the reservoir and the first and second outlets based on actuation of the first and/or second user-operable actuator, wherein the direction determination mechanism comprises a valve which is operable, in use, to provide selective fluid communication between the reservoir and one or the other of the first and second outlets, wherein the valve has a first position in which the reservoir is in fluid communication with the first outlet and a second position in which the reservoir is in fluid communication with the second outlet, wherein the first user-operable actuator is configured or configurable to bias, in use, the valve from the first position to or toward the second position.

2. Toy according to claim 1, wherein the direction determination mechanism is configured or configurable, in use, to open a second fluid flow path from the reservoir to the second outlet and to close a first fluid flow path from the reservoir to the first outlet when the first user-operable actuator has been actuated.

3. Toy according to claim 2, wherein the direction determination mechanism is configured or configurable, in use, to open the first fluid flow path from the reservoir to the first outlet and to close the second fluid flow path from the reservoir to the second outlet when the second user-operable actuator has been actuated.

4. Toy according to claim 1, wherein the second user-operable actuator is configured or configurable to bias, in use, the valve from the second position to or toward the first position.

5. Toy according to claim 1, wherein the first outlet is arranged or configured to direct or allow fluid flow, in use, from the toy toward an operator of the first user-operable actuator.

6. Toy according to claim 5, wherein the second outlet is arranged or configured to direct or allow fluid flow, in use, from the toy toward an operator of the second user-operable actuator.

7. Toy according to claim 1, wherein the reservoir is configured to retain a first volume of fluid, and the reservoir is configured or configurable, in use, to release or deliver a predetermined second volume of fluid, where the second volume is less than the first volume.

8. A toy for use by plural operators, the toy comprising: first and second user-operable actuators; a reservoir for retaining fluid; first and second outlets for emitting fluid from the reservoir to outside of the toy; and a direction determination mechanism; where the direction determination mechanism is configured or configurable, in use, to selectively allow or prevent fluid communication between the reservoir and the first and second outlets based on actuation of the first and/or second user-operable actuator, wherein the direction determination mechanism comprises a valve which is operable, in use, to provide selective fluid communication between the reservoir and one or the other of the first and second outlets, wherein the valve has a first position in which the reservoir is in fluid communication with the first outlet and a second position in which the reservoir is in fluid communication with the second outlet, wherein each of the first and second user-operable actuators comprise a cam operable in use to cause the valve to move from the first to or toward the second position or vice versa.

9. A toy for use by plural operators, the toy comprising: first and second user-operable actuators; a reservoir for retaining fluid; first and second outlets for emitting fluid from the reservoir to outside of the toy; and a direction determination mechanism; where the direction determination mechanism is configured or configurable, in use, to selectively allow or prevent fluid communication between the reservoir and the first and second outlets based on actuation of the first and/or second user-operable actuator, comprising a pressure generator for causing fluid within the reservoir to exit one or other of the first and second outlets, in use, wherein the first and/or second user-operable actuators are operable, in use, to prime the pressure generator.

10. A toy for use by plural operators, the toy comprising: first and second user-operable actuators; a reservoir for retaining fluid; first and second outlets for emitting fluid from the reservoir to outside of the toy; and a direction determination mechanism; where the direction determination mechanism is configured or configurable, in use, to selectively allow or prevent fluid communication between the reservoir and the first and second outlets based on actuation of the first and/or second user-operable actuator, comprising a fluid release mechanism for selectively allowing or causing fluid flow from the reservoir to the first outlet or the second outlet when one or each of the first and second user-operable actuators have been actuated a predetermined number of times.

11. Toy according to claim 10, wherein the fluid release mechanism comprises an indexing mechanism which is configured or configurable, in use, to allow or cause the release of fluid from the reservoir upon the final activation of the predetermined number of activations.

12. Toy according to claim 11, wherein the indexing mechanism comprises first and second gears.

13. Toy according to claim 12, wherein the first and second gears comprise a rack and a pinion gear.

* * * * *